US009091912B2

(12) United States Patent
Ogaki et al.

(10) Patent No.: US 9,091,912 B2
(45) Date of Patent: Jul. 28, 2015

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Harunobu Ogaki, Suntou-gun (JP); Yuki Yamamoto, Tokyo (JP); Akihiro Maruyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/040,222

(22) Filed: Sep. 27, 2013

(65) Prior Publication Data

US 2014/0093818 A1 Apr. 3, 2014

(30) Foreign Application Priority Data

Sep. 28, 2012 (JP) ..... 2012-215701
Aug. 8, 2013 (JP) ..... 2013-165121

(51) Int. Cl.

| | |
|---|---|
| ***G03C 1/00*** | (2006.01) |
| ***G03G 5/05*** | (2006.01) |
| ***G03G 5/06*** | (2006.01) |
| ***G03G 5/147*** | (2006.01) |
| ***G03G 21/18*** | (2006.01) |

(52) U.S. Cl.

CPC *G03C 1/00* (2013.01); *G03G 5/056* (2013.01); *G03G 5/0614* (2013.01); *G03G 5/14752* (2013.01); *G03G 21/1814* (2013.01)

(58) Field of Classification Search

CPC .. G03G 5/14752; G03G 5/056; G03G 5/0614
USPC ..... 430/66; 399/159
See application file for complete search history.

(56) References Cited

U.S. PATENT DOCUMENTS

| | | | | |
|---|---|---|---|---|
| 5,283,143 | A | 2/1994 | Yanus | |
| 7,985,522 | B2 * | 7/2011 | Tajima et al. | 430/59.6 |
| 2003/0190540 | A1 * | 10/2003 | Shoshi et al. | 430/78 |

FOREIGN PATENT DOCUMENTS

| | | | | |
|---|---|---|---|---|
| EP | 0816927 | A1 | 1/1998 | |
| EP | 0860744 | A1 | 8/1998 | |
| JP | 63-065451 | * | 3/1988 | G03G 5/14 |
| JP | 10-20514 | A | 1/1998 | |
| JP | 2006-53549 | A | 2/2006 | |
| JP | 2007-72277 | A | 3/2007 | |
| JP | 2007079555 | A | 3/2007 | |

OTHER PUBLICATIONS

Translation of abstract of JP 63-065451 published Mar. 1988.*

* cited by examiner

*Primary Examiner* — Peter Vajda
(74) *Attorney, Agent, or Firm* — Canon U.S.A. Inc., IP Division

(57) ABSTRACT

An electrophotographic photosensitive member includes a surface layer including a particular charge-transporting substance and a particular polyester resin having a particular repeating structural unit. The content of the particular repeating structural unit is 30% by mass or more based on the total mass of the polyester resin included in the surface layer.

6 Claims, 1 Drawing Sheet

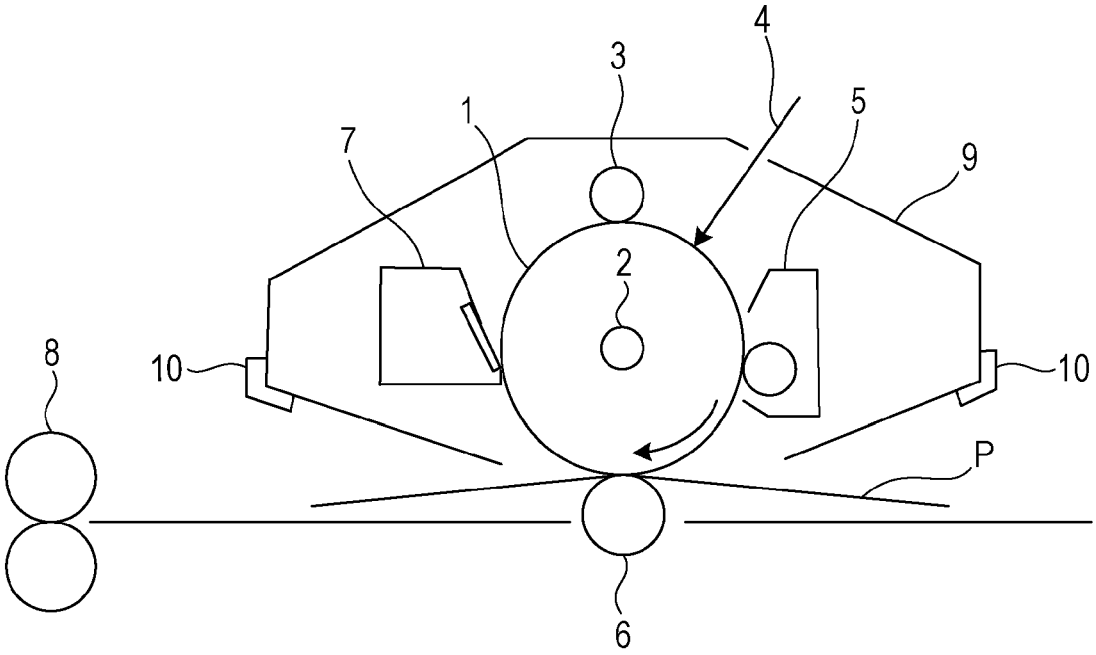
4
3
5
1
7
9
2
8
10
10
P
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member and to a process cartridge and an electrophotographic apparatus that include the electrophotographic photosensitive member.

2. Description of the Related Art

An electrophotographic photosensitive member including an organic photoconductive material is the most widely used electrophotographic photosensitive member installed in electrophotographic apparatuses.

In an electrophotographic process, the surface of the electrophotographic photosensitive member installed in an electrophotographic apparatus is brought into contact with various members such as a developer, a charging member, a cleaning blade, paper, and a transfer member (hereafter, also referred to as "contact members and the like"). Therefore, the electrophotographic photosensitive member becomes abraded and thus damaged due to the contact with these contact members and the like, which may cause degradation of image quality. Thus, a surface layer of the electrophotographic photosensitive member is required to have an enhanced mechanical strength.

In order to enhance the mechanical strength of the surface layer of an electrophotographic photosensitive member, a method in which the mechanical strength of a resin constituting the surface layer is increased has been proposed. Japanese Patent Laid-Open Nos. 10-20514 and 2006-53549 disclose that the mechanical strength of the surface layer of an electrophotographic photosensitive member may be enhanced when the surface layer includes a particular polyester resin.

As a result of studies, the inventors of the present invention have found that the use of the polyester resin that are disclosed in Japanese Patent Laid-Open Nos. 10-20514 and 2006-53549 and the charge-transporting substance having a particular structure enhance the mechanical strength of the surface layer, but on the other hand, may cause degradation of image quality when the electrophotographic photosensitive member is used repeatedly in a high-temperature, high-humidity environment and thus there is still room for further improvement.

SUMMARY OF THE INVENTION

The present invention provides an electrophotographic photosensitive member that has a high mechanical strength and that is capable of suppressing degradation of image quality due to repeated use of the electrophotographic photosensitive member in a high-temperature, high-humidity environment. The present invention also provides a process cartridge and an electrophotographic apparatus that include the electrophotographic photosensitive member.

The present invention relates to an electrophotographic photosensitive member comprising a support, a charge-generating layer on the support, and a charge-transporting layer on the charge-generating layer. A surface layer of the electrophotographic photosensitive member comprises:

at least one charge-transporting substance selected from the group consisting of a compound represented by the Formula (CTM-1), a compound represented by the Formula (CTM-4), and an enamine compound; and a polyester resin having a repeating structural unit represented by the Formula (A).

The content of the repeating structural unit represented by the Formula (A) is 30% by mass or more based on the total mass of the polyester resin included in the surface layer.

(A)

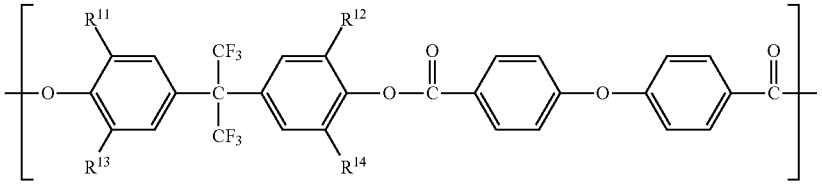

In the Formula (A), $R^{11}$ to $R^{14}$ each independently represent a hydrogen atom or a methyl group.

(CTM-1)

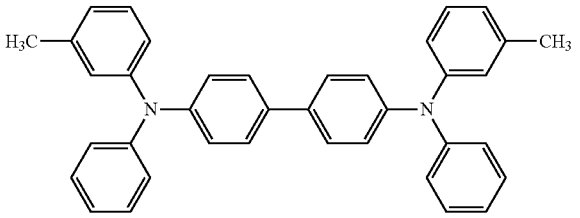

(CTM-4)

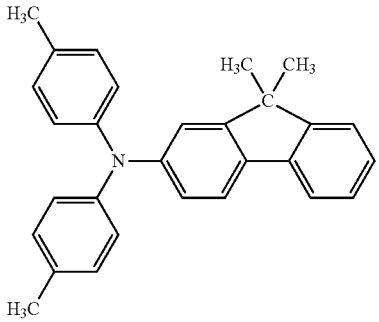

The present invention also relates to a process cartridge detachably attachable to a main body of an electrophotographic apparatus, wherein the process cartridge integrally supports: the above-described electrophotographic photosensitive member; and at least one device selected from the group consisting of a charging device, a developing device, a transfer device, and a cleaning device.

The present invention relates to an electrophotographic apparatus comprising the above-described electrophotographic photosensitive member, a charging device, an exposure device, a developing device, and a transfer device.

According to the present invention, an electrophotographic photosensitive member that has a high mechanical strength and that is capable of suppressing degradation of image quality due to repeated use of the electrophotographic photosensitive member in a high-temperature, high-humidity environment may be produced by the surface layer of the electrophotographic photosensitive member including a particular charge-transporting substance and a polyester resin having a particular repeating structural unit. In addition, according to the present invention, a process cartridge and an electrophotographic apparatus that include the electrophotographic photosensitive member may be produced.

Further features of the present invention will become apparent from the following description of exemplary embodiments with reference to the attached drawing.

BRIEF DESCRIPTION OF THE DRAWING

FIGURE is a schematic diagram illustrating an example of an electrophotographic apparatus including a process cartridge including an electrophotographic photosensitive member according to the present invention.

DESCRIPTION OF THE EMBODIMENTS

Surface Layer

A surface layer of an electrophotographic photosensitive member according to the present invention includes a charge-transporting substance and a polyester resin having a repeating structural unit represented by the Formula (A) below. The content of the repeating structural unit represented by the Formula (A) is 30% by mass or more based on the total mass of the polyester resin. More precisely, the content of the repeating structural unit represented by the Formula (A) is 30% by mass or more and 100% by mass or less based on the total mass of the polyester resin. The charge-transporting substance is at least one compound selected from the group consisting of a compound represented by the Formula (CTM-1) below, a compound represented by the Formula (CTM-4) below, and an enamine compound.

(A)

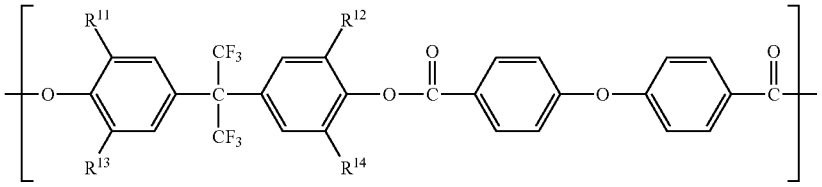

The polyester resin having the repeating structural unit represented by the Formula (A) is now described.

In the Formula (A), $R^{11}$ to $R^{14}$ each independently represent a hydrogen atom or a methyl group.

Specific examples of the repeating structural unit represented by the Formula (A) are shown below.

(A-1)

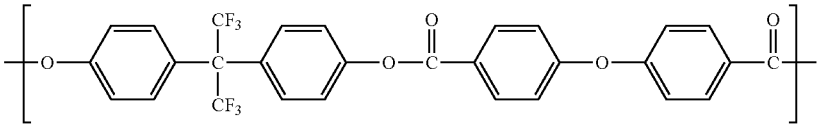

(A-2)

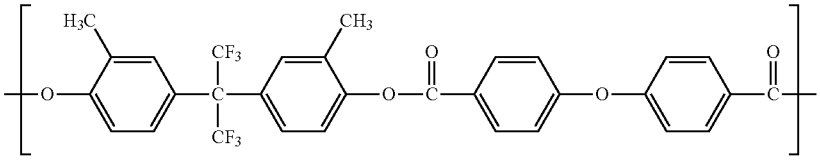

(A-3)

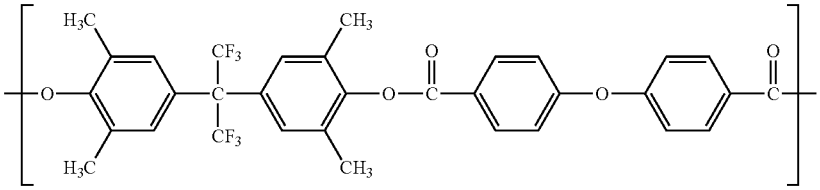

In particular, the repeating structural unit represented by the Formula (A-1) may be used because they allow degradation of image quality due to repeated use of the electrophotographic photosensitive member in a high-temperature, high-humidity environment to be suppressed to a greater degree.

The polyester resin may have two or more kinds of structural units as the repeating structural unit represented by the Formula (A). In this case, any form of copolymerization such as block copolymerization, random copolymerization, or alternating copolymerization may be used.

The weight-average molecular weight of the polyester resin is preferably 60,000 or more and 200,000 or less and more preferably 80,000 or more and 150,000 or less from the viewpoint of the mechanical strength of the surface layer.

The weight-average molecular weight of a resin herein refers to a polystyrene-equivalent weight-average molecular weight determined by a conventional method, which is described in Japanese Patent Laid-Open No. 2007-79555.

The polyester resin having the repeating structural unit represented by the Formula (A) may further have the repeating structural unit represented by the Formula (B).

(B)

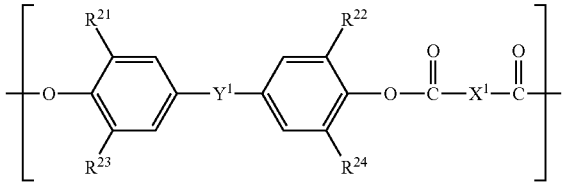

In the Formula (B), $R^{21}$ to $R^{24}$ each independently represent a hydrogen atom or a methyl group. $X^1$ represents a m-phenylene group, a p-phenylene group, or a divalent group having two p-phenylene groups bonded with an oxygen atom. In particular, $X^1$ may be a divalent group having two p-phenylene groups bonded with an oxygen atom from the viewpoint of the mechanical strength of the surface layer. $Y^1$ represents a single bond, a methylene group, an ethylidene group, a propylidene group, a phenylethylidene group, a cyclohexylidene group, or an oxygen atom. In particular, $Y^1$ may be a methylene group, an ethylidene group, or a propylidene group.

Specific examples of the repeating structural unit represented by the Formula (B) include, but are not limited to, the structural units shown below.

(B-1)

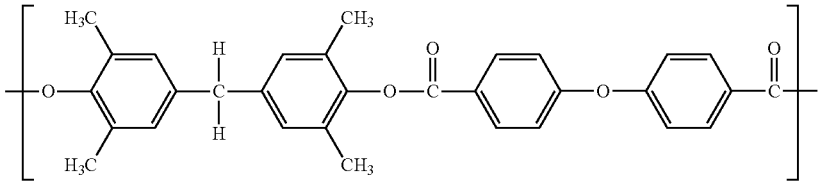

(B-2)

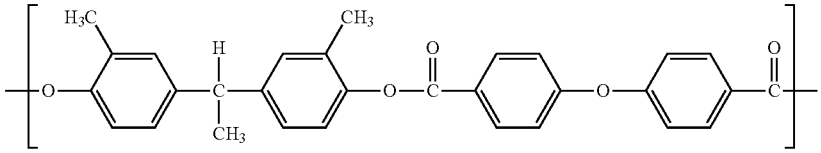

(B-3)

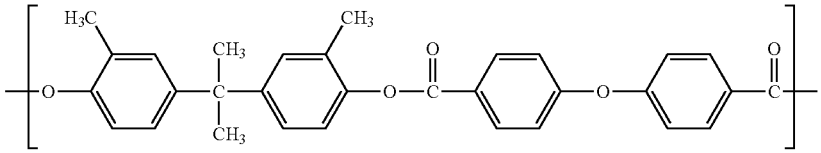

(B-4)

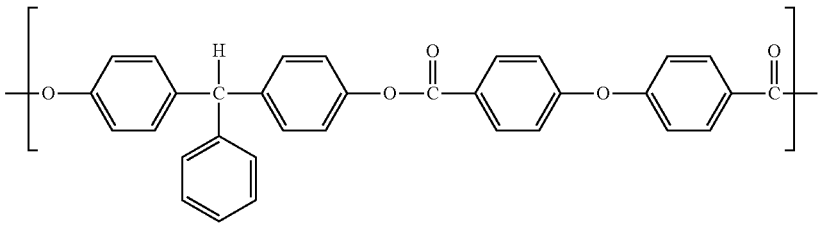

(B-5)

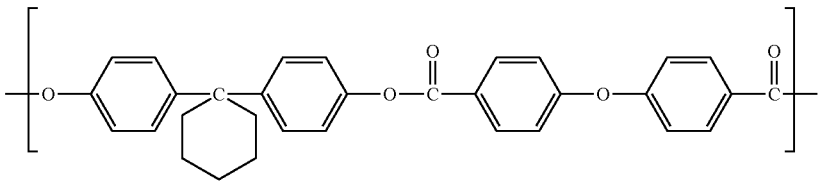

-continued
(B-6)
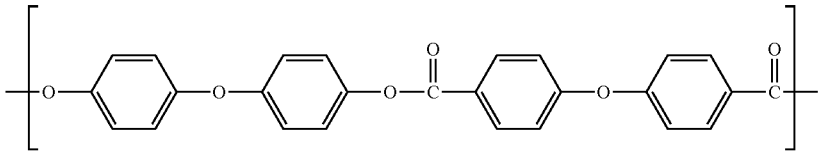
(B-7)
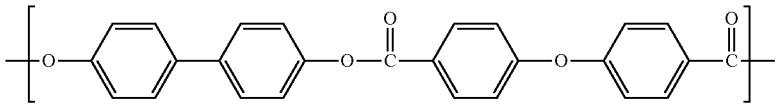
(B-8)
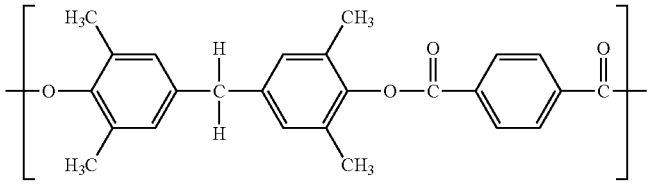
(B-9)
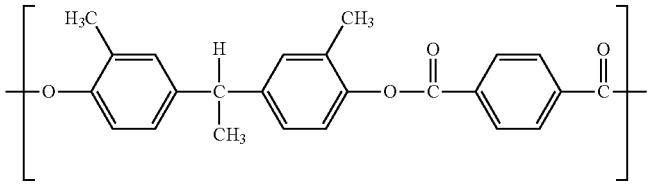
(B-10)
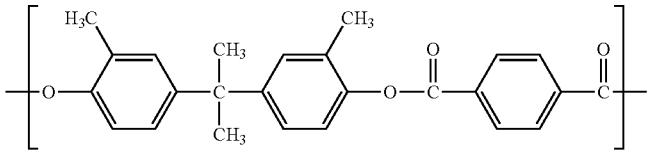
(B-11)
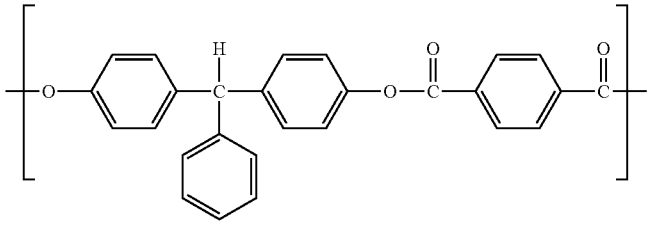
(B-12)
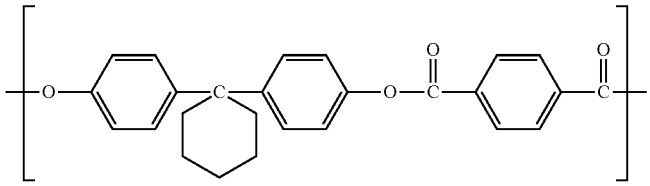
(B-13)
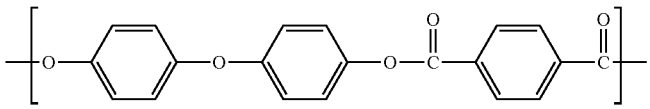
(B-14)
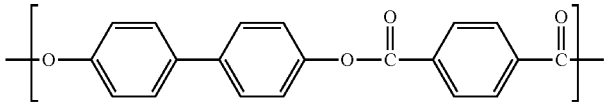

-continued (B-15)

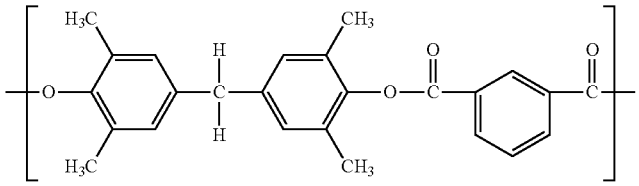

(B-16)

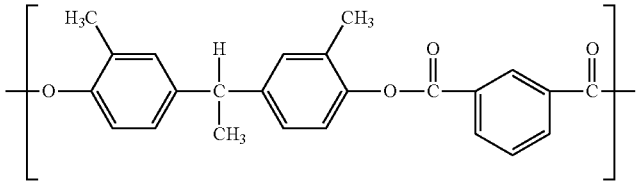

(B-17)

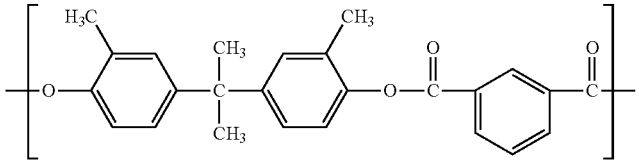

(B-18)

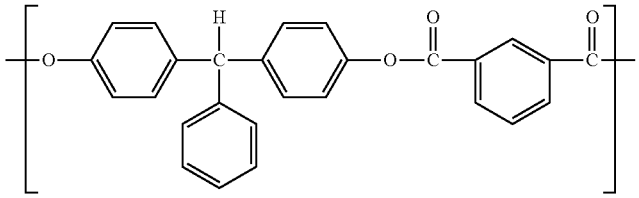

(B-19)

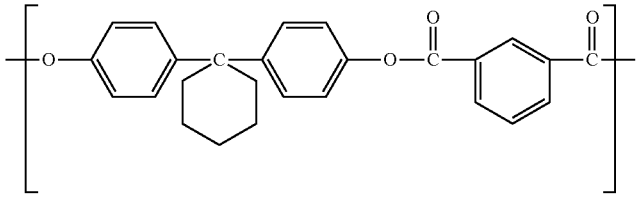

(B-20)

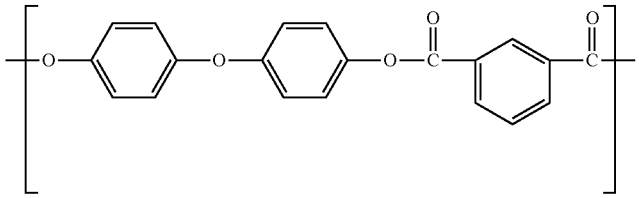

(B-21)

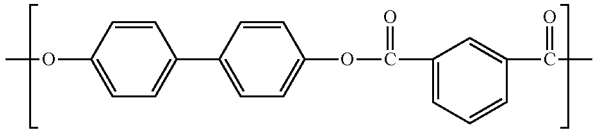

In particular, the structural units represented by the Formulae (B-2), (B-3), (B-9), (B-10), (B-16), and (B-17) may be used.

The polyester resin according to the present invention may have both the repeating structural unit represented by the Formula (A) and the repeating structural unit represented by the Formula (B). In the case of copolymerization, the mass ratio of the repeating structural unit represented by the Formula (A) is such that the content of the repeating structural unit represented by the Formula (A) is 30% by mass or more based on the total mass of the polyester resin. When this mass ratio is achieved, a marked effect of suppressing degradation of image quality due to repeated use of the electrophotographic photosensitive member in a high-temperature, high-humidity environment is produced. Any form of copolymerization such as block copolymerization, random copolymerization, or alternating copolymerization may be used.

The surface layer includes at least one charge-transporting substance selected from the group consisting of a compound represented by the Formula (CTM-1) below, a compound represented by the Formula (CTM-4) below, and an enamine compound. The charge-transporting substance (positive hole-transporting substance) included in the surface layer allows positive holes to move in the surface layer.

(CTM-1)

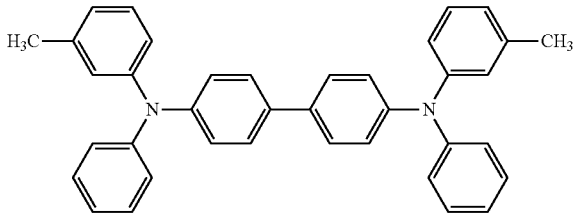

(CTM-4)

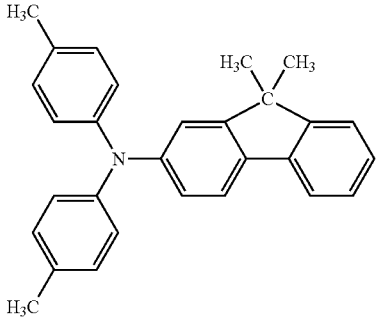

The enamine compound may be a compound represented by the Formula (D).

(D)

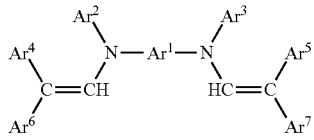

In the Formula (D), $Ar^1$ represents a phenylene group or a biphenylylene group. $Ar^1$ may be a biphenylylene group. $Ar^2$ to $Ar^7$ each independently represent an unsubstituted or substituted phenyl group. The substituent of the substituted phenyl group may be a methyl group.

Specific examples of the enamine compound include the compounds shown below. However, in the present invention, the enamine compound is not limited to these compounds.

(CTM-3)

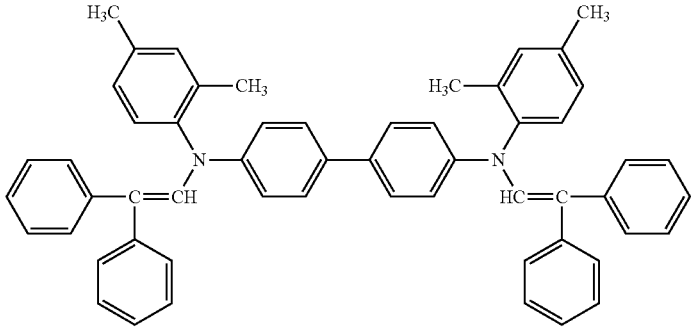

(CTM-5)

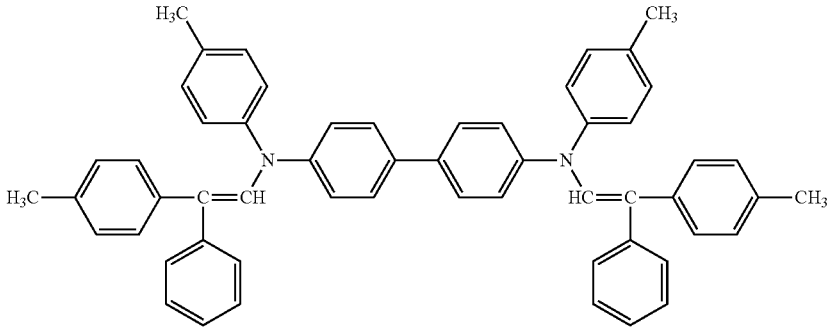

The polyester resin included in the surface layer allows degradation of image quality due to repeated use of the electrophotographic photosensitive member in a high-temperature, high-humidity environment to be suppressed. Thus, an electrophotographic photosensitive member having a high mechanical strength may be produced. The reason why the electrophotographic photosensitive member according to the present invention produces these effects is explained below. In an image-forming method using an electrophotographic photosensitive member, the electrophotographic photosensitive member is charged by a charging device. While the surface of the electrophotographic photosensitive member (the surface of the surface layer) is charged by the charging device, the surface of the surface layer reacts with activated molecules (e.g., ozone, nitrogen oxide), thereby being chemically deteriorated. Due to the chemical deterioration, the structure of the surface-layer material transforms into a structure having a higher polarity. Thus, the occurrence of the accumulation of chemical deterioration (accumulation of the chemically deteriorated surface-layer material) due to repeated use of the electrophotographic photosensitive member results in an increase in the proportion of the structure having a high polarity in the surface-layer material. In a high-temperature, high-humidity environment, the increased proportion of the structure having a high polarity causes defects in a latent image formed by the charging device and an exposure device, which results in degradation of image quality. Significant degradation of image quality due to repeated use of the electrophotographic photosensitive member in a high-temperature, high-humidity environment tends to occur when the surface layer of the electrophotographic photosensitive member has a high mechanical strength. This is because the accumulation of chemical deterioration (accumulation of the chemically deteriorated surface-layer material) is likely to occur due to the high mechanical strength.

The polyester resin having the repeating structural unit represented by the Formula (A) according to the present invention has a trifluoromethyl group in a particular portion of its structural unit and is therefore considered to allow degradation of image quality due to repeated use of the electrophotographic photosensitive member in a high-temperature, high-humidity environment to be suppressed. Generally, a carbon-fluorine bond has a high bonding strength and is a structure that is less susceptible to chemical modification. When chemical deterioration of a resin occurs, a portion between two aromatic rings is most susceptible to deterioration. Thus, when the surface layer includes a resin having a high mechanical strength, degradation of image quality due to repeated use of the electrophotographic photosensitive member may be likely to occur because of deterioration of the resin. The polyester resin according to the present invention has the trifluoromethyl group, which is less susceptible to chemical deterioration, in the portion susceptible to chemical deterioration in the structural unit represented by the Formula (A). This is considered to be a reason why the effect of the present invention is produced. In addition, when the content of the repeating structural unit represented by the Formula (A) is 30% by mass or more based on the total mass of the polyester resin, the chemical deterioration is sufficiently suppressed and thus the effect of the present invention is produced.

Synthesis Examples of the above-described polyester resin are shown below.

SYNTHESIS EXAMPLE 1

Synthesis of the Polyester Resin (1) Having the Repeating Structural Unit Represented by the Formula (A-1)

Dicarboxylic acid halide represented by the Formula (1) below (59.2 g) was dissolved in dichloromethane to prepare an acid halide solution. In addition to preparing the acid halide solution, 43.9 g of the diol represented by the Formula (2) below was dissolved in a 10% aqueous sodium hydroxide solution, and tributylbenzyl ammonium chloride was added as a polymerization catalyst to the mixture. The mixture was stirred to prepare a diol compound solution.

(1)

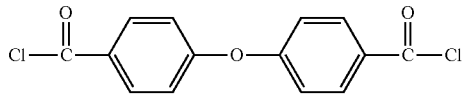

(2)

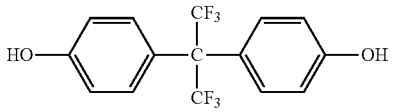

The acid halide solution was added to the diol compound solution under stirring to initiate polymerization. The polymerization was conducted for 3 hours under stirring at a reaction temperature kept at 25° C. or less.

The polymerization reaction was terminated by adding acetic acid and the resulting reaction solution was washed repeatedly with water until the water phase was neutralized. After washing, the resulting solution was added dropwise to methanol under stirring to precipitate a polymer. The polymer was subjected to vacuum drying to prepare 92 g of a polyester resin (1) having the repeating structural unit represented by the Formula (A-1) above. The weight-average molecular weight of the polyester resin (1) was 100,000 as shown in Table 1.

SYNTHESIS EXAMPLES 2 to 22

Polyester resins (2) to (22) shown in Table 1 were prepared by the same synthesis method as in Synthesis Example 1 for the polyester resin (1).

TABLE 1

| | Polyester resin | Repeating structural unit represented by the Formula (A) | Repeating structural unit represented by the Formula (B) | (A)/(B) | Weight-average molecular weight |
|---|---|---|---|---|---|
| Synthesis Example 1 | (1) | (A-1) | — | — | 100,000 |
| Synthesis Example 2 | (2) | (A-2) | — | — | 80,000 |
| Synthesis Example 3 | (3) | (A-3) | — | — | 120,000 |
| Synthesis Example 4 | (4) | (A-1)/(A-2) = 5/5 | — | — | 100,000 |
| Synthesis Example 5 | (5) | (A-1) | (B-2) | 8/2 | 100,000 |
| Synthesis Example 6 | (6) | (A-1) | (B-2) | 5/5 | 140,000 |

TABLE 1-continued

| | Polyester resin | Repeating structural unit represented by the Formula (A) | Repeating structural unit represented by the Formula (B) | (A)/(B) | Weight-average molecular weight |
|---|---|---|---|---|---|
| Synthesis Example 7 | (7) | (A-1) | (B-2) | 3/7 | 120,000 |
| Synthesis Example 8 | (8) | (A-1) | (B-2) | 7/3 | 70,000 |
| Synthesis Example 9 | (9) | (A-1) | (B-1) | 7/3 | 150,000 |
| Synthesis Example 10 | (10) | (A-1) | (B-3) | 7/3 | 120,000 |
| Synthesis Example 11 | (11) | (A-1) | (B-4) | 7/3 | 110,000 |
| Synthesis Example 12 | (12) | (A-1) | (B-5) | 7/3 | 90,000 |
| Synthesis Example 13 | (13) | (A-1) | (B-6) | 5/5 | 130,000 |
| Synthesis Example 14 | (14) | (A-1) | (B-7) | 8/2 | 120,000 |
| Synthesis Example 15 | (15) | (A-2) | (B-2) | 8/2 | 100,000 |
| Synthesis Example 16 | (16) | (A-1) | (B-8)/(B-15) = 5/5 | 7/3 | 110,000 |
| Synthesis Example 17 | (17) | (A-1) | (B-9)/(B-16) = 5/5 | 7/3 | 120,000 |
| Synthesis Example 18 | (18) | (A-1) | (B-10)/(B-17) = 5/5 | 7/3 | 80,000 |
| Synthesis Example 19 | (19) | (A-1) | (B-11)/(B-18) = 5/5 | 7/3 | 130,000 |
| Synthesis Example 20 | (20) | (A-1) | (B-12)/(B-19) = 5/5 | 7/3 | 150,000 |
| Synthesis Example 21 | (21) | (A-1) | (B-13)/(B-20) = 5/5 | 8/2 | 80,000 |
| Synthesis Example 22 | (22) | (A-1) | (B-14)/(B-21) = 5/5 | 8/2 | 90,000 |

In Table 1, "Polyester resin" is the polyester resin having the repeating structural unit represented by the Formula (A); "Repeating structural unit represented by the Formula (A)" and "Repeating structural unit represented by the Formula (B)" are each the type of repeating structural unit or mixing ratio (mass ratio) between the repeating structural units included in the polyester resin; "(A)/(B)" is the mixing ratio (mass ratio) between the repeating structural unit represented by the Formula (A) and the repeating structural unit represented by the Formula (B) included in the polyester resin; and "Weight-average molecular weight" is a polystyrene-equivalent weight-average molecular weight (Mw) of the polyester resin.

The surface layer of the electrophotographic photosensitive member, which includes the polyester resin according to the present invention as a resin, may further include other resins in a mixture. Examples of the other resins that may be used in a mixture include an acrylic resin, a polyester resin, and a polycarbonate resin. In particular, a polyester resin and a polycarbonate resin may be used. When the other resins are used in a mixture, the content of the repeating structural unit represented by the Formula (A) is preferably 30% by mass or more based on the total mass of all resins included in the surface layer.

The content of the repeating structural unit represented by the Formula (A) relative to the total mass of the polyester resin included in the surface layer and the content of the repeating structural unit represented by the Formula (A) relative to total mass of the all resins included in the surface layer can be analyzed by a common analysis method. An example of the analysis method is described below.

The surface layer of the electrophotographic photosensitive member is dissolved with a solvent. Subsequently, the resulting solution is introduced to a fraction system capable of splitting and collecting each constituent, such as a size exclusion chromatography system or a high-performance liquid chromatography system. Thus, each material included in the surface layer is fractionated. The fractionated polyester resin is then subjected to a nuclear magnetic resonance spectrum analysis or a mass analysis to determine the number of repeating structural units and the molar ratio of the repeating structural unit represented by the Formula (A), which are then converted into a content (mass ratio). In another case, the fractionated polyester resin is hydrolyzed into a carboxylic acid portion and a bisphenol portion in the presence of an alkali. The bisphenol portion is then subjected to a nuclear magnetic resonance spectrum analysis or a mass analysis to determine the number of repeating structural units and the molar ratio of the repeating structural unit represented by the Formula (A), which are then converted into a content (mass ratio).

Next, the structure of the electrophotographic photosensitive member according to the present invention will be described.

The electrophotographic photosensitive member according to the present invention is an electrophotographic photosensitive member including a support, a charge-generating layer on the support, and a charge-transporting layer on the charge-generating layer. The charge-transporting layer may be the surface layer (uppermost layer) of the electrophotographic photosensitive member.

The charge-transporting layer of the electrophotographic photosensitive member according to the present invention includes the polyester resin having the repeating structural unit represented by the Formula (A) according to the present invention.

The charge-transporting layer may have a multilayered structure. In this case, the polyester resin having the repeating structural unit represented by the Formula (A) is included at least in the top surface of the charge-transporting layer (surface layer).

A widely used electrophotographic photosensitive member is a cylindrical electrophotographic photosensitive member that generally includes a cylindrical support and photosensitive layers (charge-generating layer and charge-transporting layer) formed on the cylindrical support. Alternatively, the electrophotographic photosensitive member may have a belt-like shape or a sheet-like shape.

Support

The support used in the present invention may be a support composed of a conductive material (conductive support), and examples of the conductive material include aluminium and an aluminium alloy. When the support is composed of aluminium or an aluminium alloy, the support may be an extrusion drawing (ED) tube, an extrusion ironing (EI) tube, or a support produced by cutting these tubes, performing an electrolytic-abrasive polishing, and performing a dry or wet honing process. Examples of the support used in the present invention also include a metal support and a resin support on which a thin film composed of a conductive material such as aluminium, an aluminium alloy, or an indium-tin oxide alloy is formed. Examples of the support used in the present invention also include a metal support and a resin support on which a conductive layer including a resin and conductive particles dispersed in the resin, such as carbon black, tin oxide particles, titanium oxide particles, or silver particles, is formed.

The surface of the support may have an adequate roughness in order to prevent the formation of interference fringes. Specifically, a support prepared by processing the surface of the above-described support by horning, blasting, cutting, electrolytic polishing, or the like; and a support composed of aluminium or an aluminium alloy on which a conductive layer including conductive metal oxide particles and a resin is formed may be used. Optionally, a surface-roughening agent that roughens the surface of the conductive layer may be added to the conductive layer in order to prevent the formation of interference fringes on an output image due to the interference of light reflected from the surface of the conductive layer.

The conductive layer including conductive particles and a resin is formed on a support by mixing a powder including the conductive particles in the conductive layer. Examples of the conductive particles include carbon black, a powder of a metal such as aluminium, nickel, iron, chromium, copper, zinc, or silver, and a powder of a metal oxide such as conductive tin oxide or indium tin oxide (ITO). The conductive layer is a layer formed using a conductive-layer-forming liquid prepared by mixing the conductive particles with a resin.

Examples of the resin used in the conductive layer include a polyester resin, a polycarbonate resin, a polyvinyl butyral resin, an acrylic resin, a silicone resin, an epoxy resin, a melamine resin, a urethane resin, a phenol resin, and an alkyd resin. These resins may be used alone or in a combination of two or more.

The conductive layer may be formed by dip-coating or by solvent application using a Meyer bar or the like.

Examples of the solvent for the conductive-layer-forming liquid include an ether solvent, an alcohol solvent, a ketone solvent, and an aromatic hydrocarbon solvent.

The thickness of the conductive layer is preferably 0.2 μm or more and 40 μm or less, more preferably 1 μm or more and 35 μm or less, and further preferably 5 μm or more and 30 μm or less.

Undercoat Layer

An undercoat layer may be optionally formed between the support or the conductive layer and the charge-generating layer.

The undercoat layer may be formed by applying an undercoat-layer-forming liquid including a resin to the support or the conductive layer to form a coating film and then drying or curing the coating film.

Examples of the resin used in the undercoat layer include polyacrylic acids, methyl cellulose, ethyl cellulose, a polyamide resin, a polyimide resin, a polyamide imide resin, a polyamic acid resin, a melamine resin, an epoxy resin, and a polyurethane resin. The resin used in the undercoat layer may be a thermoplastic resin and particularly a thermoplastic polyamide resin. The polyamide resin may be a low-crystallinity or amorphous nylon copolymer that allows the undercoat-layer-forming liquid to be in the form of a solution when being applied to the support or the conductive layer.

The thickness of the undercoat layer is preferably 0.05 μm or more and 40 μm or less and more preferably 0.1 μm or more and 7 μm or less.

Optionally, the undercoat layer may include semiconductive particles, an electron-transporting substance, or an electron-accepting substance.

Charge-generating Layer

A charge-generating layer is formed on the support, the conductive layer, or the undercoat layer.

Examples of a charge-generating substance used in the electrophotographic photosensitive member include an azo pigment, a phthalocyanine pigment, an indigo pigment, and a perylene pigment. These charge-generating substances may be used alone or in a combination of two or more. Among these charge-generating substances, in particular, oxytitanium phtalocyanine, hydroxygallium phthalocyanine, chlorogallium phthalocyanine, and the like, which have a high sensitivity, may be used.

Examples of a resin used in the charge-generating layer include a polycarbonate resin, a polyester resin, a butyral resin, a polyvinyl acetal resin, an acrylic resin, a vinyl acetate resin, and a urea resin. Among these resins, in particular, a butyral resin may be used. These resins may be used alone, in a mixture, or in the form of a copolymer of two or more of these resins.

The charge-generating layer may be formed by applying a charge-generating-layer-forming liquid to the support, the conductive layer, or the undercoat layer to form a coating film and then drying the coating film. The charge-generating-layer-forming liquid is prepared by dispersing the charge-generating substance and the resin in a solvent. Alternatively, the charge-generating layer may be a film formed by depositing the charge-generating substance.

The charge-generating substance and the resin may be dispersed using, for example, a homogenizer, ultrasound, a ball mill, a sand mill, an attritor, or a roll mill.

The amount of the charge-generating substance is preferably 0.1 parts by mass or more and 10 parts by mass or less and more preferably 1 part by mass or more and 3 parts by mass or less per part by mass of the resin.

Examples of the solvent used in the charge-generating-layer-forming liquid include an alcohol solvent, a sulfoxide solvent, a ketone solvent, an ether solvent, an ester solvent, and an aromatic hydrocarbon solvent.

The thickness of the charge-generating layer is preferably 0.01 μm or more and 5 μm or less and more preferably 0.1 μm or more and 2 μm or less.

Optionally, the charge-generating layer may include various additives such as a sensitizer, an antioxidant, an ultraviolet absorber, and a plasticizer as needed. In order to prevent the delay of electric charge flow in the charge-generating layer, the charge-generating layer may include the electron-transporting substance or the electron-accepting substance.

Charge-transporting Layer

A charge-transporting layer is formed on the charge-generating layer. The charge-transporting layer may serve as the surface layer.

When the charge-transporting layer serves as the surface layer, the charge-transporting layer includes the charge-transporting substance and the polyester resin having the repeating structural unit represented by the Formula (A). The charge-transporting layer may further include other resins as described above. Examples of the other resins that may be included in the charge-transporting layer are as described above.

The charge-transporting layer may be formed by applying a charge-transporting-layer-forming liquid to the charge-generating layer to form a coating film and then drying the coating film. The charge-transporting-layer-forming liquid is prepared by dissolving the charge-transporting substance and the resins described above in a solvent.

The amount of the charge-transporting substance is preferably 0.4 parts by mass or more and 2 parts by mass or less and more preferably 0.5 parts by mass or more and 1.2 parts by mass or less per part by mass of the resin.

Examples of the solvent used in the charge-transporting-layer-forming liquid include a ketone solvent, an ester solvent, an ether solvent, and an aromatic hydrocarbon solvent. These solvents may be used alone or in a combination of two or more. Among these solvents, in particular, an ether solvent or an aromatic hydrocarbon solvent may be used from the viewpoint of resin solubility.

The thickness of the charge-transporting layer is preferably 5 μm or more and 50 μm or less and more preferably 10 μm or more and 35 μm or less.

The charge-transporting layer may include an antioxidant, an ultraviolet absorber, a plasticizer, and the like as needed.

Optionally, a protection layer may be formed on the charge-transporting layer in order to protect photosensitive layers (the charge-generating layer and the charge-transporting layer). In this case, the protection layer serves as the surface layer and thus includes the charge-transporting substance and the polyester resin having the repeating structural unit represented by the Formula (A).

The protection layer may be formed by applying a protection-layer-forming liquid to the charge-transporting layer to form a coating film and then drying the coating film. The protection-layer-forming liquid is prepared by dissolving the charge-transporting substance and the polyester resin having the repeating structural unit represented by the Formula (A) in a solvent. The charge-transporting substance is the same as the charge-transporting substance used in the surface layer.

All layers of the electrophotographic photosensitive member according to the present invention may include various additives. Examples of the additives include antidegradants such as an antioxidant, an ultraviolet absorber, and a light stabilizer; and fine particles such as organic fine particles and inorganic fine particles. Examples of the antidegradant include a hindered phenol antioxidant, a hindered amine light stabilizer, a sulfur atom-containing antioxidant, and a phosphorus atom-containing antioxidant. Examples of the organic fine particles include polymeric resin particles such as polystyrene fine particles and polyethylene resin particles. Examples of the inorganic fine particles include metal oxide particles such as silica particles and alumina particles.

The above-described layer-forming liquids may be applied to on top of one another by, for example, dip coating, spray coating, spinner coating, roller coating, Meyer bar coating, or blade coating.

Electrophotographic Apparatus

FIGURE is a schematic diagram illustrating an example of an electrophotographic apparatus including a process cartridge including the electrophotographic photosensitive member.

In FIGURE, a cylindrical electrophotographic photosensitive member 1 rotates around an axle 2 in the direction of the arrow at a predetermined circumferential velocity. Through the rotation process, the surface of the rotating electrophotographic photosensitive member 1 is uniformly charged to a predetermined positive or negative potential by a charging device 3 (primary charging device such as a charging roller). Subsequently, the electrophotographic photosensitive member 1 receives exposure light 4 (image exposure light) that is intensity-modulated on the basis of a time-series electric digital image signal of targeted image information, the exposure light 4 being output from an exposure device (not shown) such as a slit exposure or laser-beam scanning exposure device. In this manner, an electrostatic latent image based on the targeted image information is formed on the surface of the electrophotographic photosensitive member 1.

The electrostatic latent image formed on the surface of the electrophotographic photosensitive member 1 is developed with toner included in a developer included in a developing device 5 by reversal development to form a toner image. The toner image formed and supported on the surface of the electrophotographic photosensitive member 1 is transferred to a transfer material P (e.g., paper) due to a transfer bias applied by a transfer device 6 (e.g., transfer roller). The transfer material P is taken from a transfer material supply device (not shown) in synchronization with the rotation of the electrophotographic photosensitive member 1 and fed into a portion (contact portion) at which the electrophotographic photosensitive member 1 and the transfer device 6 are in contact with each other. A bias voltage having a polarity opposite to that of charges of the toner is applied to the transfer device 6 by a bias supply (not shown).

The transfer material P, to which the toner image is transferred, is separated from the surface of the electrophotographic photosensitive member 1 and then transported to a fixing device 8 to fix the toner image. The resulting image-formed object (e.g., printed materials, copied materials) is ejected from the apparatus.

After the transfer of the toner image, the surface of the electrophotographic photosensitive member 1 is cleaned by developer (toner) remaining after the transfer being removed by a cleaning device 7 (e.g., cleaning blade). Subsequently, the electrophotographic photosensitive member 1 is irradiated with preexposure light (not shown) emitted from a preexposure device (not shown) to remove the static charge on the surface thereof. Then, the electrophotographic photosensitive member 1 is used repeatedly for image forming. The preexposure may not be always necessary when the charging device 3 is a contact charging device, such as a charging roller as shown in FIGURE.

A process cartridge may be formed by selecting a plurality of components from the above-described components such as the electrophotographic photosensitive member 1, the charging device 3, the developing device 5, the transfer device 6, and the cleaning device 7 and integrally supporting them in a container. The process cartridge may be detachably attached to the main body of an electrophotographic apparatus such as a copying machine or a laser beam printer. In FIGURE, the electrophotographic photosensitive member 1, the charging device 3, the developing device 5, and the cleaning device 7 are integrally supported to form a process cartridge 9, which is detachably attached to the main body of the electrophotographic apparatus with a guiding device 10, such as a rail attached to the main body of the electrophotographic apparatus.

EXAMPLES

Hereafter, the present invention will be described further in detail with reference to Examples and Comparative Examples. However, the scope of the present invention is not limited by Examples below. In Examples, all "parts" refers to "parts by mass".

Example 1

An aluminium cylinder having a diameter of 30 mm and a length of 357.5 mm was prepared as a support (conductive support).

A conductive-layer-forming liquid was prepared by dissolving 10 parts of $SnO_2$-coated barium sulfate particles (conductive particles), 2 parts of titanium oxide (resistance-adjusting pigment), 6 parts of a phenol resin, and 0.001 parts of silicone oil (leveling agent) in a mixed solvent (4 parts of methanol and 16 parts of methoxypropanol).

The conductive-layer-forming liquid was applied to the aluminium cylinder by dip-coating to form a coating film. The coating film was cured (heat curing) at 140° C. for 30 minutes to form a conductive layer having a thickness of 20 μm.

An undercoat-layer-forming liquid was prepared by dissolving 3 parts of N-methoxymethyl nylon and 3 parts of a nylon copolymer in a mixed solvent (65 parts of methanol and 30 parts of n-butanol).

The undercoat-layer-forming liquid was applied to the conductive layer by dip-coating to form a coating film. The coating film was dried at 100° C. for 10 minutes to form an undercoat layer having a thickness of 0.8 μm.

Then, 10 parts of hydroxygallium phthalocyanine crystal (charge-generating substance) was prepared. The hydroxygallium phthalocyanine crystal had a crystal form such that strong X-ray diffraction peaks were observed at Bragg angles (2θ±0.2°) of 7.5°, 9.9°, 16.3°, 18.6°, 25.1°, and 28.3° using CuKα characteristic radiation. The hydroxygallium phthalocyanine crystal was added to a solution prepared by dissolving 5 parts of a polyvinyl butyral resin (product name: S-LEC BX-1, produced by SEKISUI CHEMICAL CO., LTD.) in 250 parts of cyclohexanone and then dispersed in an atmosphere of 23±3° C. for 1 hour using a sand mill apparatus with glass beads having a diameter of 1 mm. Then, 250 parts of ethyl acetate was added to the resulting dispersion to prepare a charge-generating-layer-forming liquid.

The charge-generating-layer-forming liquid was applied to the undercoat layer by dip-coating to form a coating film. The coating film was dried at 100° C. for 10 minutes to form a charge-generating layer having a thickness of 0.30 μm.

A charge-transporting-layer-forming liquid was prepared by dissolving 2 parts of a compound represented by the Formula (CTM-1) (charge-transporting substance), 8 parts of a compound represented by the Formula (CTM-4) (charge-transporting substance), and 10 parts of the polyester resin (1) synthesized in Synthesis Example 1 in a mixed solution (20 parts of dimethoxymethane and 60 parts of ortho-xylene).

The charge-transporting-layer-forming liquid was applied to the charge-generating layer by dip-coating to form a coating film. The coating film was dried at 120° C. for 1 hour to form a charge-transporting layer (surface layer) having a thickness of 23 μm.

Thus, an electrophotographic photosensitive member including the support, the conductive layer, the undercoat layer, the charge-generating layer, and the charge-transporting layer stacked on top of one another in this order was prepared.

Evaluations were conducted as described below.

The electrophotographic photosensitive member prepared above was installed in a copying machine MF7140 produced by CANON KABUSHIKI KAISHA, which was modified so that the charge potential (dark portion potential) and the light portion potential of the electrophotographic photosensitive member were set to −700 V and −120 V, respectively. A cleaning blade composed of a polyurethane rubber was arranged to come into contact with the surface of the electrophotographic photosensitive member at a contact angle of 27.5° and a contact pressure of 18 g/cm$^2$. The evaluations were conducted under the conditions of a temperature of 35° C. and a relative humidity of 85%.

Chemiluminescence Evaluation

Under the evaluation conditions described above, 5,000-sheet continuous paper-feed was conducted using copies having an image density of 10%. Subsequently, the electrophotographic photosensitive member was removed from the copying machine, and an evaluation sample having a surface area of 1 cm$^2$ was cut from the electrophotographic photosensitive member. The evaluation sample was subjected to a chemiluminescence analysis using CLD-100FC produced by TOHOKU ELECTRONIC INDUSTRIAL Co., Ltd. The measurement conditions were as follows: a measurement temperature of 80° C. and a measurement time of 10 seconds. The luminescence intensity (the number of photons emitted due to chemiluminescence per unit time) was measured for all radio-luminescence in the wavelength region of 420 to 610 nm; when the proportion of the structure having a high polarity in the surface layer is increased due to chemical deterioration of the surface-layer material of the electrophotographic photosensitive member, the surface-layer material emits radio-luminescence in the wavelength region of 420 to 610 nm. Table 2 shows the results.

Image Quality Evaluation

Under the evaluation conditions described above, 5,000-sheet continuous paper-feed was conducted using copies having an image density of 10%. Subsequently, a halftone image having an image density of 0.5% was formed over the entire piece of paper. The halftone image was evaluated in terms of image quality in accordance with the following criteria.

A: A uniform image was formed over the entire piece of paper.

B: Degradation of image quality (density difference, i.e., the presence of a portion in which the image density of 0.5% was not achieved) was observed on the piece of paper in a proportion of greater than 0% and 30% or less.

C: Degradation of image quality (density difference, i.e., the presence of a portion in which the image density of 0.5% was not achieved) was observed on the piece of paper in a proportion of greater than 30%.

Table 2 shows the results.

Abrasion Loss Evaluation

Under the evaluation conditions described above, 5,000-sheet continuous paper-feed was conducted using copies having an image density of 10%. Subsequently, the electrophotographic photosensitive member was removed from the copying machine, and a change in the thickness of the electrophotographic photosensitive member before and after the 5,000-sheet continuous paper-feed was measured. The evaluation was conducted using an eddy-current thickness tester FISCHERSCOPE MMS. Table 2 shows the results.

Examples 2 and 3

An electrophotographic photosensitive member was prepared and evaluated as in Example 1, except that a certain polyester resin and a certain charge-transporting substance shown in Table 2 were used instead of those used in Example 1. Table 2 shows the results.

Comparative Examples 1 to 4

An electrophotographic photosensitive member was prepared and evaluated as in Example 1, except that a resin having a certain repeating structural unit shown in Table 2 was used instead of the polyester resin having the repeating structural unit represented by the Formula (A) used in Example 1 and a certain charge-transporting substance shown in Table 2 was used instead of that used in Example 1. Table 2 shows the results.

The weight-average molecular weights of the resins used in Comparative Examples were as follows: 120,000 in Comparative Example 1, 90,000 in Comparative Example 2, and 130,000 in Comparative Example 3.

Reference Examples 1 and 2

An electrophotographic photosensitive member was prepared and evaluated as in Example 1, except that a resin having a certain repeating structural unit shown in Table 2 was used instead of the polyester resin having the repeating structural unit represented by the Formula (A) used in Example 1 and a certain charge-transporting substance shown in Table 2 was used instead of that used in Example 1. Table 2 shows the results.

The weight-average molecular weights of the resins used in Reference Examples were as follows: 80,000 in Reference Example 1 and 100,000 in Reference Example 2.

Reference Example 3

An electrophotographic photosensitive member was prepared and evaluated as in Example 1, except that a resin (weight-average molecular weight: 120,000) having the repeating structural unit represented by the Formula (C-1) below and the repeating structural unit represented by the Formula (C-2) below was used instead of the polyester resin having the repeating structural unit represented by the Formula (A) used in Example 1 and a certain charge-transporting substance shown in Table 2 was used instead of that used in Example 1. Table 2 shows the results.

(C-1)

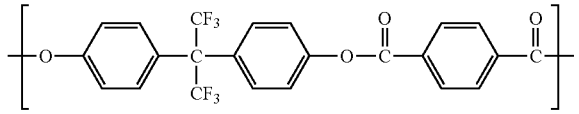

(C-2)

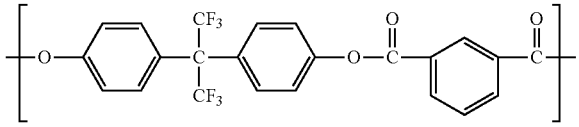

Reference Example 4

An electrophotographic photosensitive member was prepared and evaluated as in Example 1, except that a resin having a certain repeating structural unit shown in Table 2 was used instead of the polyester resin having the repeating structural unit represented by the Formula (A) used in Example 1 and the charge-transporting substance represented by the Formula (CTM-2) was used instead of that used in Example 1. Table 2 shows the results.

TABLE 2

(CTM-2)

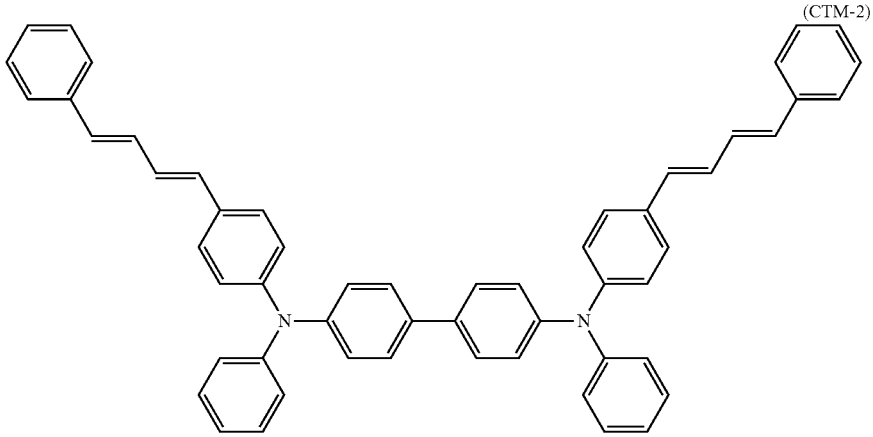

| | Resin | Charge-transporting substance | Chemiluminescence evaluation (count) | Image quality evaluation | Abrasion loss evaluation (μm) |
|---|---|---|---|---|---|
| Example 1 | Polyester resin (1) | (CTM-1) (CTM-4) = 2/8 | 1,500 | A | 0.9 |
| Example 2 | Polyester resin (6) | (CTM-3) = 10 | 2,500 | A | 1.0 |
| Example 3 | Polyester resin (4) | (CTM-5) = 10 | 2,000 | A | 1.0 |
| Comparative Example 1 | (B-2) | (CTM-3) = 10 | 35,000 | B | 0.8 |
| Comparative Example 2 | (B-3) | (CTM-1)/ (CTM-4) = 2/8 | 20,000 | B | 0.8 |
| Comparative Example 3 | (B-5) | (CTM-3) = 10 | 80,000 | C | 0.9 |
| Comparative Example 4 | (A-1)/(B-2) = 1/9 | (CTM-3) = 10 | 33,000 | B | 0.9 |
| Reference Example 1 | (B-9)/(B-16) = 5/5 | (CTM-3) = 10 | 3,200 | A | 1.4 |
| Reference Example 2 | (B-10)/(B-17) = 5/5 | (CTM-1)/ (CTM-4) = 2/8 | 2,000 | A | 1.4 |

TABLE 2-continued

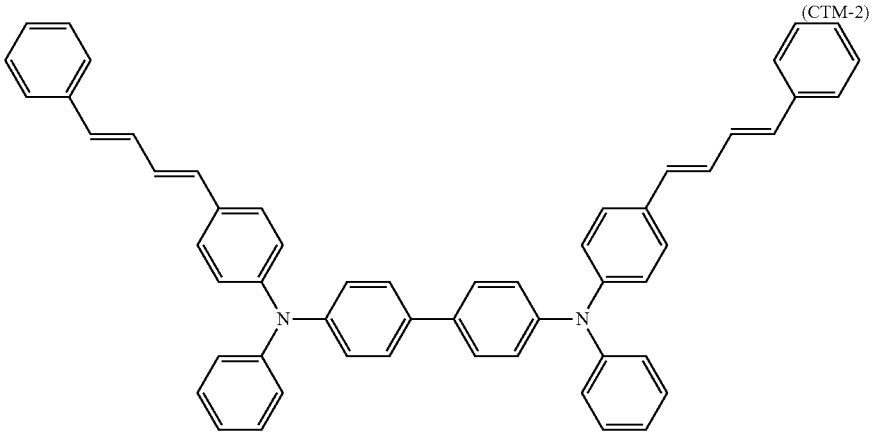

| | Resin | Charge-transporting substance | Chemiluminescence evaluation (count) | Image quality evaluation | Abrasion loss evaluation (μm) |
|---|---|---|---|---|---|
| Reference Example 3 | (C-1)/(C-2) = 5/5 | (CTM-1)/(CTM-4) = 2/8 | 1,500 | A | 1.5 |
| Reference Example 4 | (B-2) | (CTM-2) = 10 | 32,000 | B | 0.6 |

The above results of Examples, Comparative Examples, and Reference Examples show that the electrophotographic photosensitive member including the charge-transporting layer including the charge-transporting substance and the polyester resin according to the present invention has a high mechanical strength and may allow degradation of image quality due to repeated use of the electrophotographic photosensitive member to be suppressed. In the image quality evaluation after repeated use of the electrophotographic photosensitive member, Examples and Reference Examples 1 to 3 showed good results. However, in the abrasion loss evaluation, a large amount of abrasion loss was observed in Reference Examples 1 to 3, in other words, the electrophotographic photosensitive members of Reference Examples 1 to 3 had a poor mechanical strength. A large amount of abrasion loss resulted in the small amount of accumulation of chemical deterioration of the surface of electrophotographic photosensitive member because the chemically deteriorated portion in the surface of the electrophotographic photosensitive member was removed due to the abrasion when the electrophotographic photosensitive member was repeatedly used. In the chemiluminescence evaluation, a small amount of accumulation of chemical deterioration (accumulation of the chemically degraded surface layer material) was observed. The comparison between Examples and Comparative Examples shows that the amount of abrasion loss was substantially equal. However, Comparative Examples showed poor results in the image quality evaluation after repeated use of the electrophotographic photosensitive member and high values in the chemiluminescence evaluation. A high value measured in the chemiluminescence evaluation indicates degradation of the resin included in the surface layer due to electric discharge occurred in a charging process in electrophotographic image formation. Specifically, an oxidation degradation of the resin included in the surface layer is considered to occur.

Therefore, when an electrophotographic photosensitive member included the polyester resin having the repeating structural unit represented by the Formula (A) and the charge-transporting substance by the Formula, the electrophotographic photosensitive member showed stable results in terms of oxidation degradation because the polyester resin included the repeating structural unit represented by the Formula (A), which has a trifluoromethyl group at a certain portion, in a certain proportion or more.

As described above, when the surface layer included the charge-transporting substance according to the present invention and the polyester resin having the repeating structural unit represented by the Formula (A) according to the present invention, degradation of image quality occurred when the surface layer includes a polyester resin having a high mechanical strength was suppressed. Thus, both the high mechanical strength and suppressing of degradation of image quality due to repeated use of the electrophotographic photosensitive member were achieved.

Examples 4 to 27

An electrophotographic photosensitive member was prepared as in Example 1, except that a certain polyester resin and a certain charge-transporting substance shown in Table 2 were used instead of those used in Example 1. The image quality evaluation and the abrasion loss evaluation were conducted as in Example 1. Table 3 shows the results. In Examples 23 to 25, the polyester resin (1) and a resin (weight-average molecular weight: 120,000) having the repeating structural unit represented by the Formula (B-2) were used. In Example 26, 7 parts of the polyester resin (1) and 3 parts of a resin (weight-average molecular weight: 80,000) having a repeating structural unit represented by the Formula (B-9) and a repeating structural unit represented by the Formula (B-16) in a ratio of 5:5 were used. In Example 27, 5 parts of the polyester resin (1) and 5 parts of a resin (weight-average molecular weight: 80,000) having a repeating structural unit represented by the Formula (B-9) and a repeating structural unit represented by the Formula (B-16) in a ratio of 5:5 were used.

TABLE 3

| | Resin | Charge-transporting substance | Chemiluminescence evaluation (count) | Image quality evaluation | Abrasion loss evaluation (μm) |
|---|---|---|---|---|---|
| Example 4 | Polyester resin (2) | (CTM-1)(CTM-4) = 2/8 | 2,000 | A | 1.0 |
| Example 5 | Polyester resin (3) | (CTM-1)(CTM-4) = 2/8 | 2,500 | A | 0.9 |
| Example 6 | Polyester resin (5) | (CTM-1)(CTM-4) = 2/8 | 2,300 | A | 0.9 |
| Example 7 | Polyester resin (7) | (CTM-1)(CTM-4) = 2/8 | 7,000 | A | 1.0 |
| Example 8 | Polyester resin (8) | (CTM-1)(CTM-4) = 2/8 | 2,400 | A | 1.2 |
| Example 9 | Polyester resin (9) | (CTM-1)(CTM-4) = 2/8 | 3,500 | A | 0.8 |
| Example 10 | Polyester resin (10) | (CTM-1)(CTM-4) = 2/8 | 2,000 | A | 0.9 |
| Example 11 | Polyester resin (11) | (CTM-1)(CTM-4) = 2/8 | 2,700 | A | 1.0 |
| Example 12 | Polyester resin (12) | (CTM-1)(CTM-4) = 2/8 | 3,500 | A | 0.9 |
| Example 13 | Polyester resin (13) | (CTM-1)(CTM-4) = 2/8 | 2,000 | A | 0.9 |
| Example 14 | Polyester resin (14) | (CTM-1)(CTM-4) = 2/8 | 2,000 | A | 1.0 |
| Example 15 | Polyester resin (15) | (CTM-1)(CTM-4) = 2/8 | 2,700 | A | 1.0 |
| Example 16 | Polyester resin (16) | (CTM-1)(CTM-4) = 2/8 | 3,500 | A | 1.1 |
| Example 17 | Polyester resin (17) | (CTM-1)(CTM-4) = 2/8 | 2,500 | A | 1.1 |
| Example 18 | Polyester resin (18) | (CTM-1)(CTM-4) = 2/8 | 3,000 | A | 1.1 |
| Example 19 | Polyester resin (19) | (CTM-1)(CTM-4) = 2/8 | 3,000 | A | 1.0 |
| Example 20 | Polyester resin (20) | (CTM-1)(CTM-4) = 2/8 | 3,700 | A | 1.1 |
| Example 21 | Polyester resin (21) | (CTM-1)(CTM-4) = 2/8 | 2,300 | A | 0.9 |
| Example 22 | Polyester resin (22) | (CTM-1)(CTM-4) = 2/8 | 2,300 | A | 0.9 |
| Example 23 | Polyester resin (1)/(B-2) = 7/3 | (CTM-3) = 10 | 2,800 | A | 1.0 |
| Example 24 | Polyester resin (1)/(B-2) = 5/5 | (CTM-3) = 10 | 3,700 | A | 0.9 |
| Example 25 | Polyester resin (1)/(B-2) = 3/7 | (CTM-3) = 10 | 7,500 | A | 0.9 |
| Example 26 | Polyester resin (1)/(B-9)/(B-16) = 7/1.5/1.5 | (CTM-3) = 10 | 3,000 | A | 1.0 |
| Example 27 | Polyester resin (1)/(B-9)/(B-16) = 5/2.5/2.5 | (CTM-3) = 10 | 4,500 | A | 1.0 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-215701 filed Sep. 28, 2012 and No. 2013-165121 filed Aug. 8, 2013, which are hereby incorporated by reference herein in their entirety.

What is claimed is:

1. An electrophotographic photosensitive member comprising:

a support;

a charge-generating layer on the support; and a charge-transporting layer on the charge-generating layer, wherein, a surface layer of the electrophotographic photosensitive member comprises:

at least one charge-transporting substance selected from the group consisting of a compound represented by the Formula (CTM-1), a compound represented by the Formula (CTM-4), and an enamine compound; and a polyester resin having a repeating structural unit represented by the Formula (A) and a repeating structural unit represented by the Formula (B), and wherein, the content of the repeating structural unit represented by the Formula (A) is 30% by mass or more based on the total mass of the polyester resin included in the surface layer, (A)

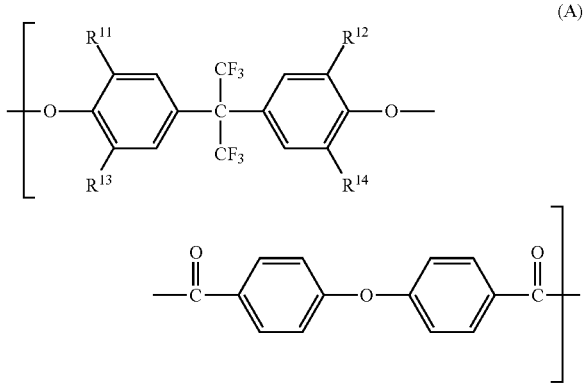

where, $R^{11}$ to $R^{14}$ each independently represent a hydrogen atom or a methyl group, (B)

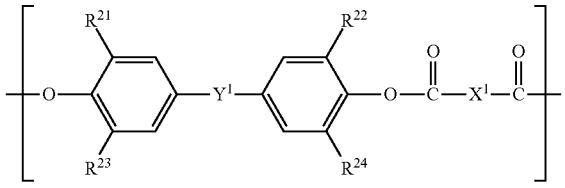

where, $R^{21}$ to $R^{24}$ each independently represent a hydrogen atom or a methyl group;

$X^1$ represents a divalent group having two p-phenylene groups bonded with an oxygen atom; and $Y^1$ represents a single bond, a methylene group, an ethylidene group, a propylidene group, a phenylethylidene group, a cyclohexylidene group, or an oxygen atom, (CTM-1)

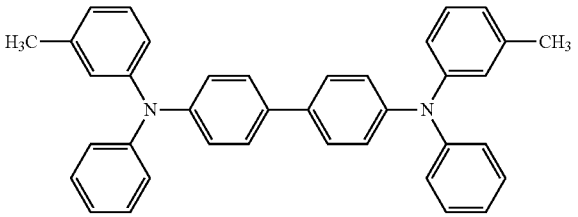

(CTM-4)

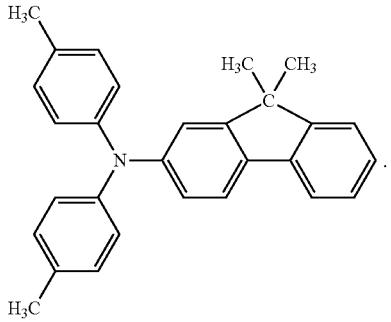

2. The electrophotographic photosensitive member according to claim 1, wherein, the enamine compound is a compound represented by the Formula (D)

(D)

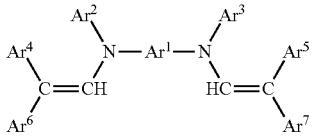

where, $Ar^1$ represents a phenylene group or a biphenylylene group; and $Ar^2$ to $Ar^7$ each independently represent an unsubstituted or substituted phenyl group.

3. The electrophotographic photosensitive member according to claim 1, wherein, the content of the repeating structural unit represented by the Formula (A) is 30% by mass or more based on the total mass of all resins included in the surface layer.

4. The electrophotographic photosensitive member according to claim 1, wherein, the surface layer is the charge-transporting layer.

5. A process cartridge detachably attachable to a main body of an electrophotographic apparatus, wherein the process cartridge integrally supports:

the electrophotographic photosensitive member according to claim 1; and at least one device selected from the group consisting of a charging device, a developing device, a transfer device, and a cleaning device.

6. An electrophotographic apparatus comprising:

electrophotographic photosensitive member according to claim 1;

a charging device;

an exposure device;

a developing device; and a transfer device.

* * * * *